United States Patent [19]

Pine

[11] Patent Number: 4,895,411

[45] Date of Patent: Jan. 23, 1990

[54] SHIFTABLE CARRIAGE MECHANISM FOR INCLINER CHAIR

[75] Inventor: James J. Pine, Tupelo, Miss.

[73] Assignee: DBJU Inc., Verona, Miss.

[21] Appl. No.: 268,508

[22] Filed: Nov. 8, 1988

Related U.S. Application Data

[63] Continuation-in-part of Ser. No. 250,115, Sep. 28, 1988.

[51] Int. Cl.[4] ..... A47C 1/02

[52] U.S. Cl. ..... 297/88; 297/68; 297/89

[58] Field of Search ..... 297/88, 89, 68, 85, 297/70, DIG. 7

[56] References Cited

U.S. PATENT DOCUMENTS

| | | | |
|---|---|---|---|
| 4,071,275 | 1/1978 | Rogers, Jr. | 297/85 |
| 4,291,913 | 9/1981 | Kowalski | 297/88 |
| 4,367,895 | 1/1983 | Pacitti | 297/88 X |
| 4,437,701 | 3/1984 | Mizelle | 297/88 X |
| 4,477,118 | 10/1984 | Ruble | 297/85 |
| 4,690,454 | 9/1987 | Mizelle | 297/89 |

*Primary Examiner*—James T. McCall

*Attorney, Agent, or Firm*—Watson, Cole, Grindle & Watson

[57] ABSTRACT

A shiftable carriage mechanism for an incliner chair includes a right support assembly, a left support assembly, a torque tube connected between the right and left support assemblies and an operating lever, each of the right and left support assemblies including a frame subassembly having a base member mountable on the chair frame, and a mounting rail movably positioned above the base member; a toggle drive subassembly for locking the mounting rail above the base member or, when unlocked, for moving the mounting rail towards the base member; and a footrest-legrest subassembly which will become extended when the mounting rail is moved towards the base member. No main extension spring connected between the mounting rails and the base members is utilized.

15 Claims, 6 Drawing Sheets

SHIFTABLE CARRIAGE MECHANISM FOR INCLINER CHAIR

CROSS-REFERENCE TO RELATED APPLICATION

The present application is a continuation-in-part of application Ser. No. 250,115, filed Sept. 28, 1988.

BACKGROUND OF THE INVENTION

1. Field of the Invention

The present invention relates to an incliner chair, and more particularly to the carriage mechanism mounted therein which operates to move the seat, backrest, legrest and footrest when the incliner chair is converted from its upright state to its reclined state, and vice versa.

2. The Prior Art

An incliner chair, otherwise known as a "one-way" recliner chair, is a chair which employs a shiftable carriage mechanism that mounts the seat and backrest such that they will retain the same position and orientation relative to one another when the chair is converted between its upright state and its reclined state, i.e., so that the seat and backrest effectively form a unit. The frame of the chair in which the shiftable carriage mechanism is mounted remains stationary on the flooring surface on which it is positioned.

The early incliner chairs included no positive locking mechanisms or extension springs because they were weight or "gravity" operated. Later developed incliner chairs, which often contained overstuffed seats and back cushions, as well as fabrics which would not easily slide over each other, incorporated a main extension spring to help move the seat and backrest when the chair was converted to its reclined state (sometimes the occupant of the chair would not be heavy enough to cause the chair to convert to its reclined state). However, in the upright state of the chair the main extension spring would be stretched to its maximum extent and apply a large force tending to convert the chair to its reclined state, thus necessitating the use of a locking mechanism to prevent inadvertent reclining of the chair. These locking mechanisms included an auxiliary spring in order to bias them into a locked condition. However, the use of both a main extension spring and an auxiliary spring for the locking mechanism results in a carriage mechanism which is complex and costly to manufacture.

SUMMARY OF THE INVENTION

It is an object of the present invention to provide a shiftable carriage mechanism for an incliner chair which does not require the use of a main extension spring as utilized in prior art incliner chairs, e.g., to overcome upholstery rub.

It is a further object of the invention to provide a shiftable carriage mechanism for an incliner chair wherein the spring used to bias the locking mechanism therein also functions as the spring that helps overcome upholstery rub when the chair is converted from its upright to its reclined states.

According to the invention, the shiftable carriage mechanism utilizes interconnected right and left support assemblies which each include a frame subassembly, a toggle drive subassembly and a footrest-legrest subassembly. The frame subassembly includes a base member attached to a side member of the chair frame and a mounting rail for the seat and backrest of the chair and is movably mounted above the base member. The toggle drive subassembly, which is connected between the mounting rail and the base member of the frame subassembly, is capable of being in either a locked or an unlocked state. When in its locked state, the carriage mechanism will be in its retracted condition (which corresponds to the incliner chair being in its upright state) and when in its unlocked stat the toggle drive assembly will operate to help the weight of the occupant in the chair move the mounting rail downwardly towards the base member and thereby shift the carriage mechanism into its extended condition (which corresponds to the incliner chair being in its reclined state). No main extension spring attached to and extending between the mounting rail and the base member is needed.

A further understanding of the invention will be achieved by reference to the accompanying drawings, taken in conjunction with the following discussion.

DETAILED DESCRIPTION OF THE PREFERRED EMBODIMENTS

Figure 3:
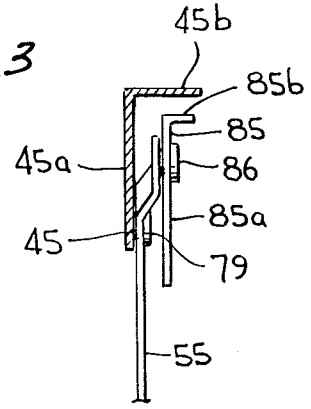
FIG. 3 is a cross-sectional view of the shiftable carriage mechanism as seen along line 3—3 in FIG. 2, i.e., showing a cross-sectional view through the right support assembly thereof.
Figure 1:
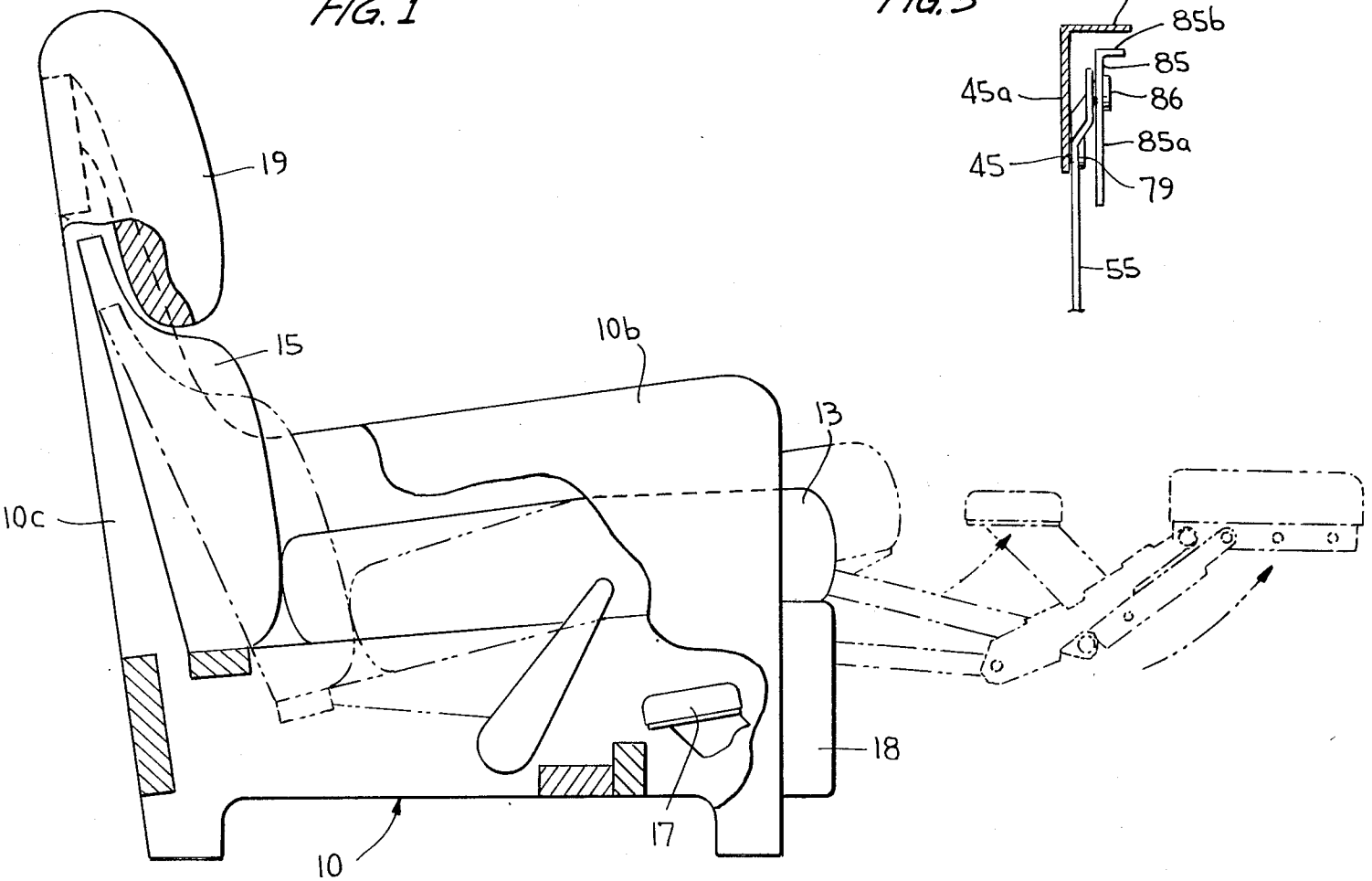
FIG. 1 is a schematic side view of an incliner chair which incorporates a shiftable carriage mechanism according to a first embodiment of the present invention, the relative positioning of the seat, backrest, legrest and footrest when the shiftable carriage mechanism is in its retracted condition (upright state of the chair) being shown in solid lines and their relative positioning when the shiftable carriage mechanism is in its extended condition (reclined state of the chair) being shown in phantom.
Figure 2:
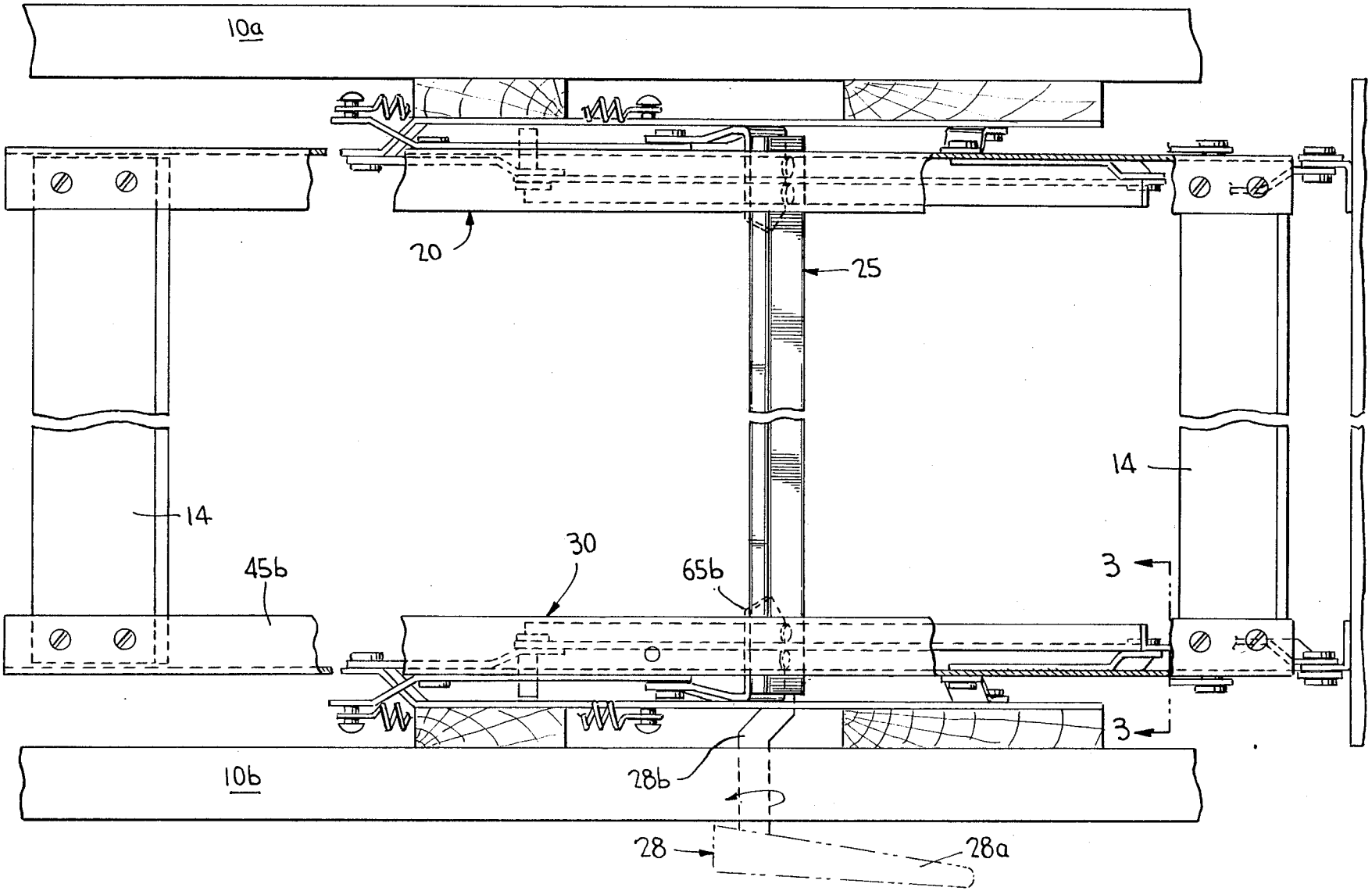
FIG. 2 is a top plan view of the shiftable carriage mechanism mounted within the incliner chair of FIG. 1 when in its retracted condition.

An incliner chair which incorporates a shiftable carriage mechanism for supporting and moving the seat, backrest, legrest and footrest thereof according to a first embodiment of the present invention is schematically shown in FIG. 1. The chair comprises a frame 10 that includes left and right side members 10*a*,10*b* (see FIG. 2) that provide support legs along their lower edges and armrests along their upper edges, and an upwardly-extending back member 10*c*. The frame 10 is intended to remain stationary on the surface on which it is positioned regardless of whether the incliner chair is in its upright or reclined states. The incliner chair also includes a seat 13, a backrest 15, a legrest 17, a footrest 18 and a headrest cushion 19. The seat, backrest, legrest and footrest are mounted on the shiftable carriage mechanism of the invention, which in turn is mounted on the left and right side members 10*a*,10*b* of the chair. When the shiftable carriage mechanism is in its retracted condition, which corresponds to the chair being in its upright state, the seat 13 will be generally horizontally oriented, the backrest will be generally vertically oriented, and both the legrest 17 and footrest 18 will be positioned beneath the seat 13 (see the solid line positions of these elements in FIG. 1). When the shiftable carriage mechanism is shifted to its extended condition, which corresponds to the chair being in its reclined state, the front end of the seat 13 will be inclined upwardly with respect to its rear end, the backrest 15 will be inclined rearwardly, and both the legrest 17 and footrest 18 will be positioned in front of the seat (see the phantom line positions of these elements in FIG. 1). However, the relative positioning and orientation of the seat and backrest will remain the same. The headrest cushion 19, which is attached to the top of the back member 10*c* of the frame 10, hangs down to cover the upper end of the backrest 15 irrespective of whether the chair is in its upright or reclined states.

The shiftable carriage mechanism in the incliner chair of FIG. 1 is shown in detail in FIGS. 2–5. It includes a left support assembly 20, a right support assembly 30, a torque tube 25 which is interconnected between the left and right support assemblies, and an outer operating lever 28 which is connected to the torque tube 25. The left side assembly 20 is constructed to be a mirror image of the right side assembly 30. As such, a description of the right side assembly will suffice to describe the left side assembly. In the following description of the right side assembly 30, the terms outer and outwardly will relate to a relative location or side opposite (facing away from) the left side assembly of the shiftable carriage mechanism and the terms inner and inwardly will relate to the location or side towards (facing) the left side assembly.

Figure 4:
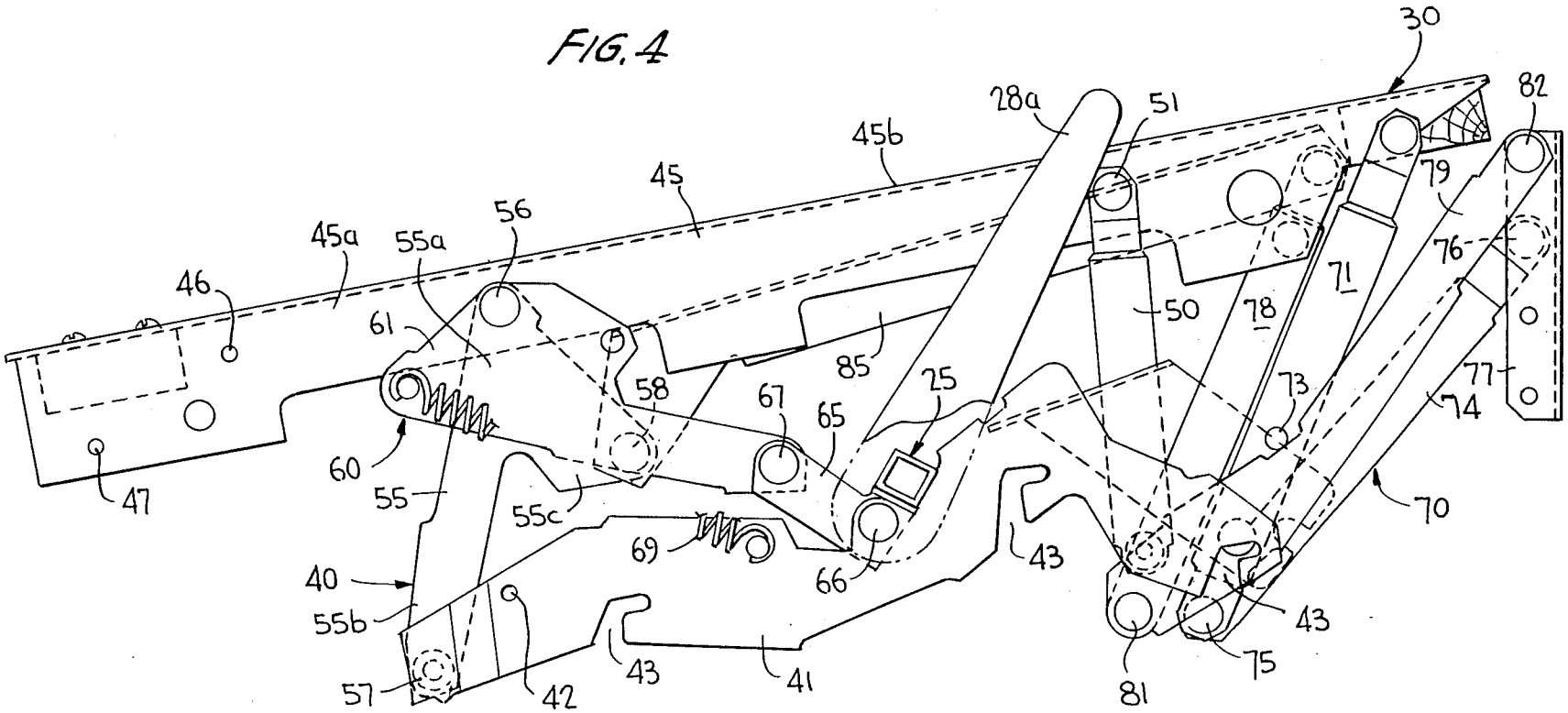
FIG. 4 is a right side elevational view of the shiftable carriage mechanism of FIG. 2, a portion of its outer operating lever being broken away to better show the elements of the right support assembly therebehind.

As best seen in FIG. 4, the right support assembly 30 includes a frame subassembly 40, a toggle drive subassembly 60 and a footrest-legrest subassembly 70. Referring first to the frame subassembly 40, it includes an angular base member 41 which has a hole 42 near its rear end and three slots 43 along its length to enable it to be fixedly attached by suitable screws or bolts to the right side member 10*b* of the incliner chair (the corresponding base member of the left support assembly 20 is of course similarly attached to the left side member 10*a* of the chair 10). The frame subassembly also includes an elongated mounting rail 45 which is movably mounted above the base member 41 by front and rear strut members 50 and 55. The mounting rail 45 includes a vertical flange 45*a* and an inwardly-extending transverse flange 45*b*. The transverse flange includes suitable holes near its front and rear ends (see FIG. 2) for attachment to the ends of front and rear cross beams 14 for supporting the seat 13. The vertical flange 45*a* includes screw holes 46,47 at its rear end for connection to the bottom of the backrest 15. The mounting rail supports the seat and backrest in a fixed relation to one another.

The front strut member 50, which has a rectilinear configuration, has a top end which is located outwardly of the vertical flange 45*a* of the mounting rail 45 and is pivotally connected thereto by a pivot pin 51, while its lower end is located inwardly of the base member 41 and is pivotally connected thereto by a pivot pin 52. The rear strut member 55 is configured to have a head portion 55*a*, a first downwardly-extending leg portion 55*b* and a second downwardly-extending leg portion 55*c*. Its head portion 55*a* is located inwardly of the vertical flange 45*a* of the mounting rail 45 and is pivotally connected thereto by a pivot pin 56, while the lower end of its first leg portion is located inwardly of the base member 41 and is pivotally connected thereto by a pivot pin 57. The second leg portion 53*c*, which is shorter in length than the first leg portion and extends forwardly thereof, is connected by a pivot pin 58 to the rear end of a drive arm 85 of the footrest-legrest subassembly 80 (described below). The front and rear strut members are connected to the mounting rail 45 such that, starting from the positioning shown in FIG. 4, clockwise rotation of these strut elements about the respective pivot pins 52 and 57 will cause the mounting rail to incline upwardly as it descends towards the base member 41.

Figure 8:
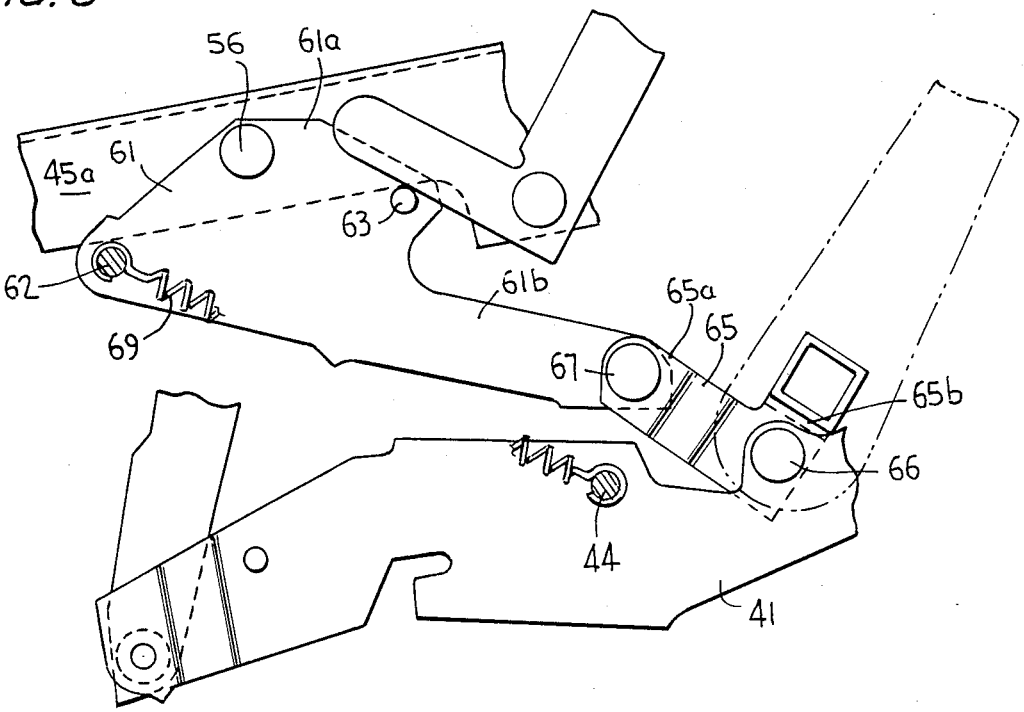

The toggle drive subassembly 60 is connected between the base member 41 and the mounting rail 45 of the support subassembly 40. It comprises an upper toggle link 61, a lower toggle link 65 and a drive spring 69. The upper toggle link 61 is configured to have a head portion 61*a* (see FIG. 8) and a forwardly-extending leg portion 61*b*. The head portion 61*a* is located outwardly of the vertical flange 45*a* of the mounting rail 45 and is pivotally connected to the vertical flange by the pivot pin 56. The lower toggle link 65 includes a first leg 65*a* and a transverse second leg 65*b*. The first leg 65*a* has a lower end that is located inwardly of the base member 41 and is pivotally connected thereto by a pivot pin 66 and an upper end which is located outwardly of the lower end of the leg portion 61*b* of the upper toggle link 61 and is pivotally attached thereto by a pivot pin 67. The transverse second leg 65*b* extends inwardly of the first leg 65*a* at its lower end and includes holes 68 for attachment to the associated end of the torque tube 25 (see FIG. 2). The drive spring 69 extends from a stud 62 that projects outwardly from a rear end of the head portion 61*a* of the upper toggle link 61 to a stud 44 that projects outwardly from the base member 41 at a point rearwardly of the pivot pin 66. An abutment pin 63 extends inwardly from the front end of the head portion 61*a* of the upper toggle link 61 to contact a lower edge of the vertical flange 45*a* of the mounting rail 45, i.e., when the toggle drive subassembly is in its locked state (which corresponds to the right support assembly, and thus the shiftable carriage mechanism as a whole, being in its retracted condition). When the toggle drive subassembly is in its locked state, the pivot pins 56, 67 and 66 will be aligned along an imaginary line.

The footrest-legrest subassembly 70, which is of the pantograph or lazy-tong type, includes a first link arm 71 (see FIG. 5) which is pivotally attached at its upper end to the front end of the vertical flange 452 of the mounting rail 45 by a pivot pin 72, a second link arm 74 whose lower end is pivotally attached by a pivot pin 75 to the lower end of the first link arm and at its upper end to a footrest bracket 77 by a pivot pin 76, a third link arm 78 which is pivotally attached near its upper end to the vertical flange 45*a* of the mounting rail 45 by a pivot pin 79 located rearwardly of and below the pivot pin 72, and a fourth link arm 79 whose lower end is pivotally attached by pivot pin 81 to the lower end of the third link arm 78 and whose upper end is attached to the footrest bracket 77 by a pivot pin 82 located rearwardly of the pivot pin 76. In addition, the fourth link arm 79 is also pivotally attached to the first link arm 71 by a pivot pin 83 located above the pivot pin 75. Its pivotal movement relative to the first link arm, both when the footrest-legrest subassembly is retracted and when extended, is limited by an upper edge thereof abutting against a stop pin 73 projecting from the first link arm. A generally L-shaped, legrest platform 84 is attached to the second link arm 74 near its lower end. A drive arm 85 that includes a vertical flange 85*a* and an inwardly-extending transverse flange 85*b* (see FIG. 3) is positioned behind the vertical flange 45*a* of the mounting rail is connected at its rear end to the pivot pin 58 and at its front end to the upper end of the third link arm 78 by a pivot pin 86.

The outer operating lever 28 includes a grip arm 28*a* located externally of the right side member 10*a* of the frame 10 of the incliner chair and an angular extension arm 28*b* which the upholstery fabric thereon) and into the adjacent end of the torque tube 25.

Figure 5:
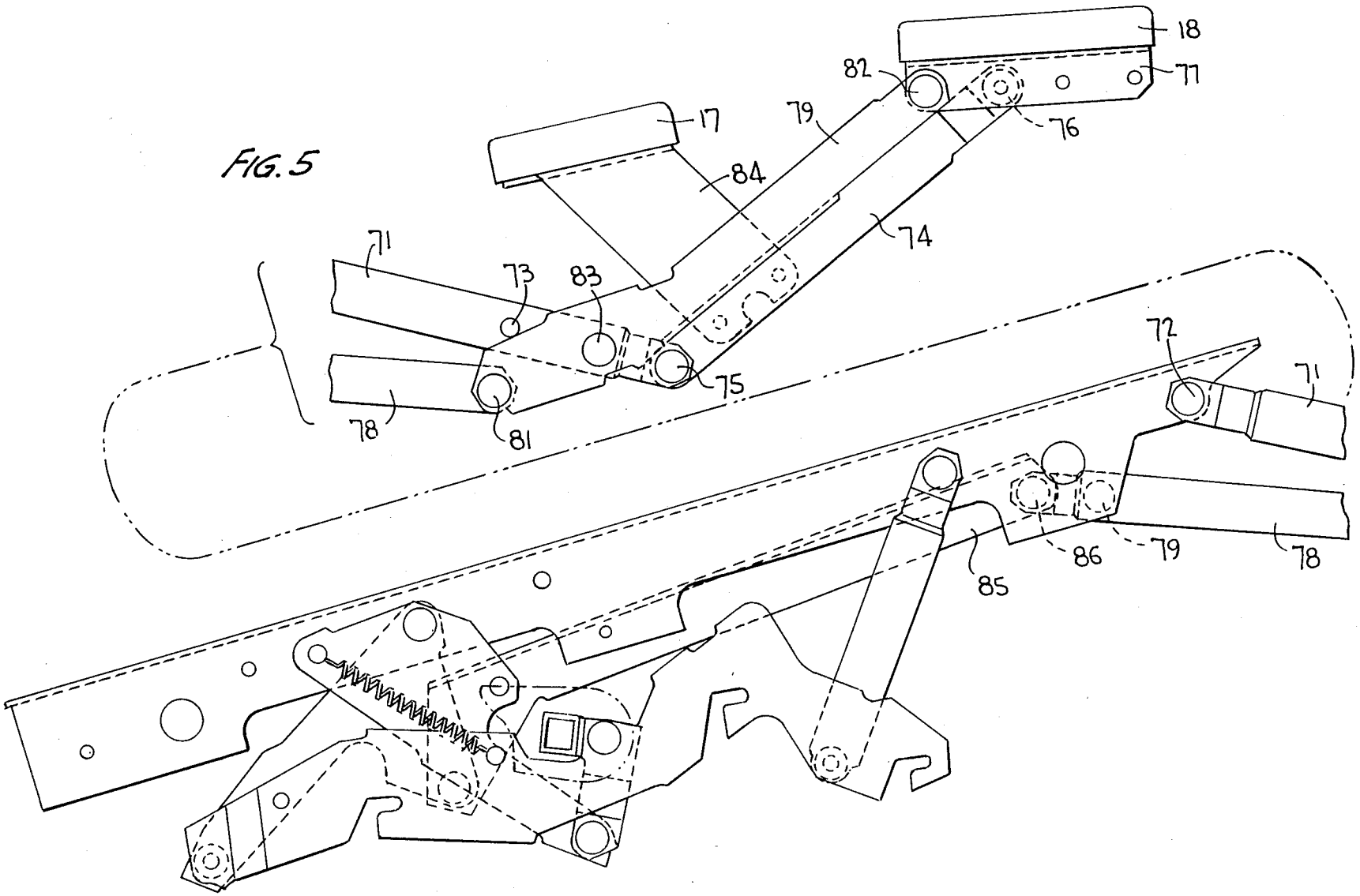
FIG. 5 is a right side elevational view of the shiftable carriage mechanism of FIG. 2 when in its extended condition, its outer operating lever being only partially shown in phantom.
Figure 9:
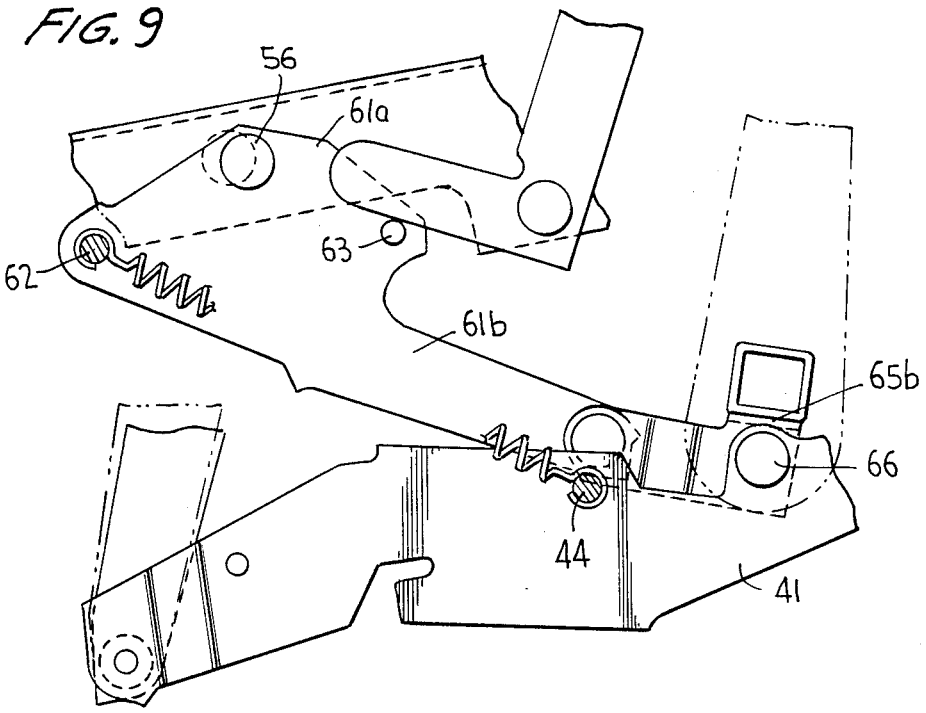

When the right support assembly 30 is in its retracted condition, the left support assembly 20 will also be in its retracted condition, and the shiftable carriage mechanism as a whole will be in its retracted condition. This condition corresponds to the incliner chair being in its upright state. The elements of the frame subassembly 40, the toggle drive subassembly 60 and the footrest-legrest subassembly 70 of the right support assembly will be positioned and oriented relative to one another as shown in FIG. 4, and the elements of the corresponding subassemblies of the left support assembly 20 will be similarly positioned and oriented. The abutment pin 63 on the head portion of the upper toggle link 61 of the toggle drive subassembly will contact the lower edge of the vertical flange 45*a* of the mounting rail 45 due to the force of drive spring 69 (and the weight of any occupant in the chair) and the upper and lower toggle links 61,65 will be in a locked state. The grip arm 28*a* of the outer operating lever 28 will be oriented forwardly. Upon a manual pulling (counterclockwise rotation) of the grip arm 28*a*, the first leg portion 65*a* of the lower toggle link 65 will be caused to rotate about the pivot pin 66 until the positioning indicated in FIG. 9 is reached. At this point the upper and lower toggle links 61,65 will no longer be in a locked state, and this will allow the drive spring 69, via rotation of the front and rear strut members 50 and 55, to assist the weight of a person sitting in the chair in moving the mounting rail 45 downwardly and somewhat forwardly relative to the base member 41, and to also incline upwardly, while simultaneously rearwardly moving the drive arm 85 of the footrest-legrest subassembly 69. This movement of drive arm 85 will cause the third link arm 78 of the footrest-legrest subassembly to rotate about pivot pin 79, which in turn will cause the first, second and fourth link arms to rotate about pivot pins 72,75,76,81,82 and 83 so as to become repositioned and forwardly extended as shown in FIG. 5. In this way, the right support assembly (and in a similar manner the left support assembly) will be shifted, such that the shiftable carriage mechanism will be shifted into its extended condition, which corresponds to the reclined state of the incliner chair of FIG. 1. The right and left support assemblies can be retracted and the toggle drive subassemblies thereof returned to their locked states by clockwise rotation of the grip arm 28*a* and/or application of downward force on the footrest 18 by the feet of an occupant in the chair.

Figures 6, 7:
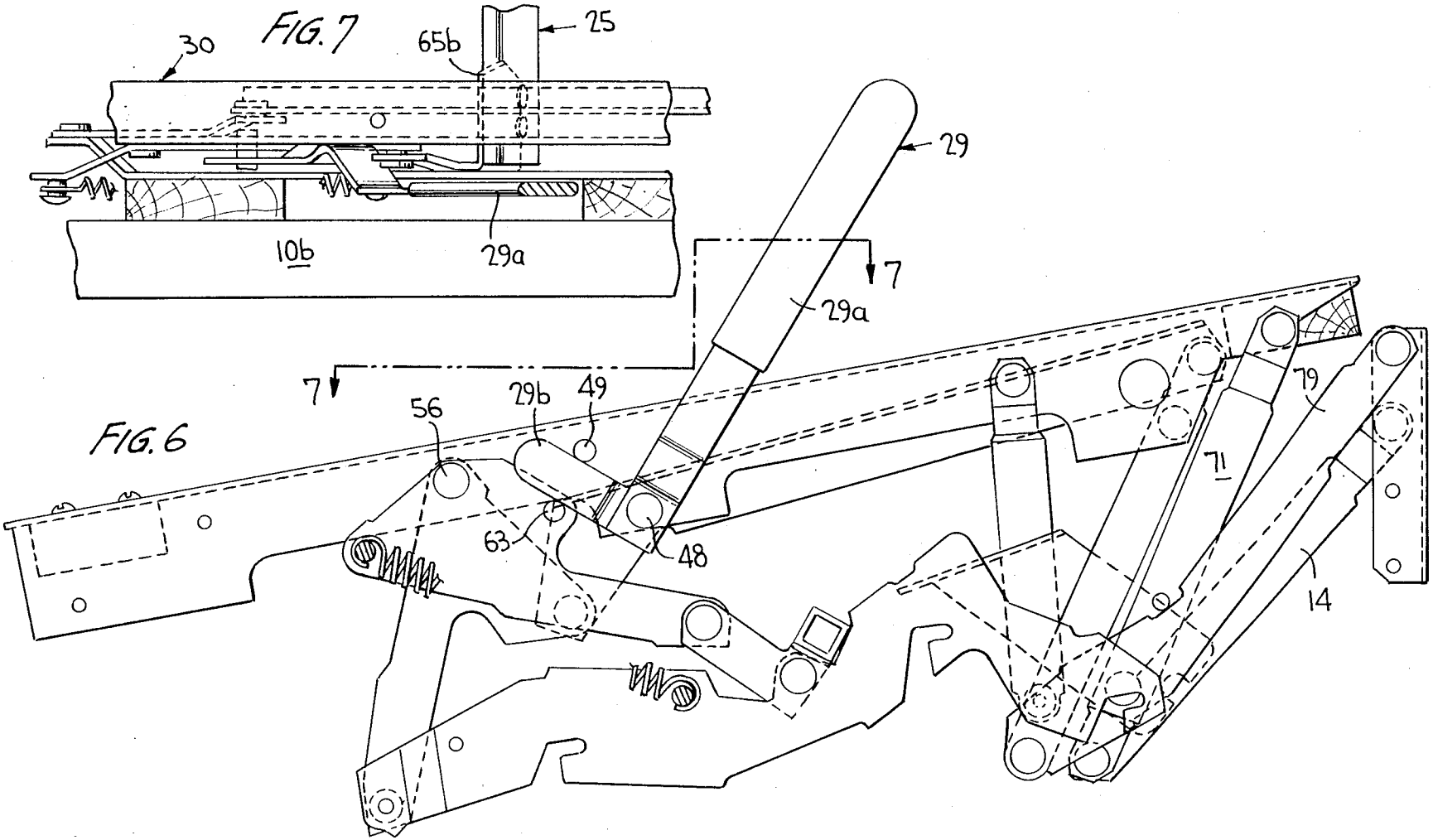
FIG. 6 is a right side elevational view of a second embodiment of a shiftable carriage mechanism according to the present invention when in its retracted condition, this embodiment utilizing an inner operating lever instead of the outer operating level of the first embodiment.
FIG. 7 is in view of FIG. 6 as seen along line 7—7 therein, and FIGS. 8 and 9 enlarged details of FIG. 6, FIG. 8 showing the relative positioning of the toggle links of the toggle drive subassembly of the right support assembly and the orientation of the inner operating lever when in a locked state, which corresponds to the shiftable carriage mechanism being in a retracted condition (this figure also shows in phantom the corresponding orientation of the outer operating lever of the first shiftable carriage mechanism embodiment), and FIG. 9 showing the relative positioning of the toggle links just after manual rotation of the inner operating lever (alternatively the outer operating lever) has caused the toggle links to rotate relative to one another into an unlocked state, thus enabling the drive spring of the toggle drive subassembly to help shift the shiftable carriage mechanism into its extended condition.

FIG. 6 shows a second embodiment of the inventive shiftable carriage mechanism which is almost identical to the first embodiment except that the outer operating lever is replaced with an inner operating lever. This inner operating lever 29 includes a grip arm 29*a* that is attached to the outside of the vertical flange 45*a* of the mounting rail 45 by a pivot pin 48 and an extension arm 29*b* which is abuttable against the abutment pin 63. The grip arm 29*a* is designed to be positioned inside of the right side member 10*b* and the associated upholstery fabric of the frame 10 of the incliner chair (see FIG. 7). Counterclockwise rotation of the grip arm 29*a* by the occupant of the chair will cause the extension arm 29*b* to rotate the upper toggle link 61 clockwise about the pivot pin 56 to as to achieve movement of the upper and lower toggle links to the positioning shown in FIG. 9, and thus an unlocking of the toggle drive subassembly. The counterclockwise rotation of the extension arm 29*b* is limited by a stop pin 49 which extends outwardly from the vertical flange 45*a* of the mounting rail 45.

Although two preferred embodiments of the inventive shiftable carriage mechanism have now been shown and described in detail, it is obvious that modifications therein can be made and still fall within the scope of the appended claims. For example, a combination of the two described shiftable carriage mechanism embodiments is possible wherein the shiftable carriage mechanism employs both outer and inner operating levers.

I claim:

1. A support assembly for use in a shiftable carriage mechanism employed to support the seat, backrest, footrest and legrest of an incliner chair, said support assembly comprising a frame subassembly which includes an elongated base member that is fixedly connectable to the incliner chair, an elongated mounting rail for supporting the seat and backrest of the incliner chair in a fixed relation to one another, and front and rear strut members which pivotally mount the mounting rail above the base member, a toggle drive subassembly which is connected between the mounting rail and the base member of the frame subassembly and is capable of being in a locked state wherein it will cause the mounting rail to be fixed in position above the base member or in an unlocked state wherein it will cause the mounting rail to move downwardly towards the base member, and a footrest-legrest subassembly for supporting the legrest and footrest of the incliner chair and which is connected to said frame subassembly and to said toggle drive subassembly so as to be in a retracted condition when the upper and lower toggle links of the toggle drive subassembly are in their locked state and in an extended condition when the upper and lower toggle links are in their unlocked state.

2. A support assembly according to claim 1, wherein said toggle drive subassembly includes an upper toggle link which is pivotally connected to the mounting rail, a lower toggle link which is pivotally connected to both the base member and to the upper toggle link, and a drive spring which extends from the upper toggle link to the base member, said upper and lower toggle links being repositionable from a locked state wherein the mounting rail is fixedly positioned with respect to one another against the force of the drive spring to an unlocked state wherein the drive spring will cause the mounting rail to move towards the base member.

3. A support assembly according to claim 2, wherein said upper toggle link includes an abutment pin which abuts against said mounting rail when in its locked state.

4. A shiftable carriage mechanism for movably supporting the seat, backrest, footrest and legrest of an incliner chair, said shiftable carriage mechanism being shiftable from a retracted condition which corresponds to the incliner chair being in an upright state to an extended condition which corresponds to the incliner chair being in a reclined state, said shiftable carriage mechanism comprising identical right and left support assemblies which each include a frame subassembly which includes an elongated base member that is fixedly connectable to the incliner chair, an elongated mounting rail for supporting the seat and backrest of the incliner chair in a fixed relation to one another, and front and rear strut members which pivotally mount the mounting rail above the base member, a toggle drive subassembly which is connected between the mounting rail and the base member of the frame subassembly and is capable of being in a locked state wherein it will cause the mounting rail to be fixed in position above the base member or in an unlocked state wherein it will cause the mounting rail to move downwardly towards the base member, and a footrest-legrest subassembly for supporting the legrest and footrest of the incliner chair and which is connected to said frame subassembly and to said toggle drive subassembly so as to be in a retracted condition when the upper and lower toggle links of the toggle drive subassembly are in their locked state and in an extended condition when the upper and lower toggle links are in their unlocked state, a torque tube connected between the toggle drive subassemblies of the right and left support assemblies, and an operating lever which is manually operable to cause the toggle drive subassemblies of both the right and left support assemblies to be in their locked or unlocked states.

5. A shiftable carriage mechanism according to claim 4, wherein the toggle drive subassembly of each of said right and left support assemblies includes an upper toggle link which is pivotally connected to the mounting rail, a lower toggle link which is pivotally connected to both the base member and to the upper toggle link, and a drive spring which extends from the upper toggle link to the base member, said upper and lower toggle links being repositionable from a locked state wherein the mounting rail is fixedly positioned with respect to one another against the force of the drive spring to an unlocked state wherein the drive spring will cause the mounting rail to move towards the base member.

6. A shiftable carriage mechanism according to claim 5, wherein the upper toggle link of the toggle drive subassembly of each of said right and left support assemblies includes an abutment pin which abuts against the mounting rail to which it is attached when in its locked state.

7. A shiftable carriage mechanism according to claim 5, wherein said torque tube is connected between the lower toggle links of the toggle drive subassemblies of each of said right and left support assemblies.

8. A shiftable carriage mechanism according to claim 7, wherein said operating lever comprises a grip arm which is positioned externally of a side member of the incliner chair and an extension arm which extends through an opening in the side member of the incliner chair and into an adjacent end of said torque tube.

9. A shiftable carriage mechanism according to claim 7, wherein said operating lever comprises a grip arm which is pivotally attached to the mounting rail of the frame subassembly of said right support assembly and an extension arm which is abuttable against an abutment pin on the upper toggle link of the associated toggle drive subassembly.

10. An incliner chair which includes a right side member, a left side member, a back member, a seat, a backrest, a legrest, a footrest and a shiftable carriage mechanism mounted between the right and left side members to support the seat, backrest, legrest and footrest and to shift them from a retracted condition wherein the seat is generally horizontally oriented, the backrest is generally vertically oriented, and the legrest and footrest are located beneath the seat (the upright state of the incliner chair) to an extended condition wherein the seat is upwardly inclined, the backrest is rearwardly inclined and the legrest and footrest are located in front of the seat (reclined state of the incliner chair), the seat and backrest remaining in the same relative position to one another at all times, said shiftable carriage mechanism comprising right and left support assemblies which each include a frame subassembly which includes an elongated base member that is fixedly connectable to the incliner chair, an elongated mounting rail for supporting the seat and backrest of the incliner chair in a fixed relation to one another, and front and rear strut members which pivotally mount the mounting rail above the base member, a toggle drive subassembly which is connected between the mounting rail and the base member of the frame subassembly and is capable of being in a locked state wherein it will cause the mounting rail to be fixed in position above the base member or in an unlocked state wherein it will cause the mounting rail to move downwardly towards the base member, and a footrest-legrest subassembly for supporting the legrest and footrest of the incliner chair and which is connected to said frame subassembly and to said toggle drive subassembly so as to be in a retracted condition when the upper and lower toggle links of the toggle drive subassembly are in their locked state and in an extended condition when the upper and lower toggle links are in their unlocked state, a torque tube connected between the toggle drive subassemblies of the right and left support assemblies, and an operating lever which is manually operable to cause the toggle drive subassemblies of both the right and left support assemblies to be in their locked or unlocked states.

11. An incliner chair according to claim 10, wherein the toggle drive subassembly of each of said right and left support assemblies includes a upper toggle link which is pivotally connected to the mounting rail, a lower toggle link which is pivotally connected to both the base member and to the upper toggle link, and a drive spring which extends from the upper toggle link to the base member, said upper and lower toggle links being repositionable from a locked state wherein the mounting rail is fixedly positioned with respect to one another against the force of the drive spring to an unlocked state wherein the drive spring will cause the mounting rail to move towards the base member.

12. An incliner chair according to claim 11, wherein wherein the upper toggle link of the toggle drive subassembly of each of said right and left support assemblies includes an abutment pin which abuts against the mounting rail to which it is attached when in its locked state.

13. An incliner chair according to claim 11, wherein said torque tube is connected between the lower toggle links of the toggle drive subassemblies of each of said right and left support assemblies.

14. An incliner chair according to claim 13, wherein said operating lever comprises a grip arm which is positioned externally of a side member of the incliner chair and an extension arm which extends through an opening in the side member of the incliner chain and into an adjacent end of said torque tube.

15. An incliner chair according to claim 13, wherein said operating lever comprises a grip arm which is pivotally attached to the mounting rail of the frame subassembly of said right support assembly and an extension arm which is abutable against an abutment pin on the upper toggle link of the associated toggle drive subassembly.

* * * * *

UNITED STATES PATENT AND TRADEMARK OFFICE

CERTIFICATE OF CORRECTION

PATENT NO. : 4,895,411

DATED : January 23, 1990

INVENTOR(S) : James J. Pine

It is certified that error appears in the above-identified patent and that said Letters Patent is hereby corrected as shown below:

Column 5, line 8, replace "452" with --45a--;

line 38, after "which" insert --extends through an opening in the right side member 10a (and--.

Signed and Sealed this

Third Day of December, 1991

*Attest:*

HARRY F. MANBECK, JR.

*Attesting Officer*

*Commissioner of Patents and Trademarks*